US008182071B2

(12) United States Patent
Kuk

(10) Patent No.: US 8,182,071 B2
(45) Date of Patent: May 22, 2012

(54) THERMAL INKJET PRINTHEAD AND METHOD OF DRIVING SAME

(75) Inventor: Keon Kuk, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 522 days.

(21) Appl. No.: 12/389,113

(22) Filed: Feb. 19, 2009

(65) Prior Publication Data

US 2010/0039477 A1 Feb. 18, 2010

(30) Foreign Application Priority Data

Aug. 14, 2008 (KR) ..... 10-2008-0079925

(51) Int. Cl.
*B41J 2/05* (2006.01)

(52) U.S. Cl. ..... 347/62; 347/58

(58) Field of Classification Search ..... 347/54, 347/62, 63, 58
See application file for complete search history.

(56) References Cited

U.S. PATENT DOCUMENTS

| | | | | |
|---|---|---|---|---|
| 2005/0116971 | A1 | 6/2005 | Tsai | |
| 2007/0247274 | A1 * | 10/2007 | Gasse et al. | 338/215 |
| 2008/0158303 | A1 | 7/2008 | Kang et al. | |

FOREIGN PATENT DOCUMENTS

| | | | |
|---|---|---|---|
| EP | 1 942 004 | | 7/2008 |
| JP | 63-42868 | | 2/1988 |
| JP | 03-132364 | * | 6/1991 |
| JP | 2003-291349 | | 10/2003 |
| JP | 2003-291350 | | 10/2003 |

OTHER PUBLICATIONS

European Search Report issued in European Application No. 09156060.7, mailed Nov. 27, 2009.
English language abstract of JP 63-42868, published Feb. 24, 1988.
English language abstract of JP 2003-291349, published Oct. 14, 2003.
Machine English language translation of JP 2003-291349, published Oct. 14, 2003.
English language abstract of JP 2003-291350, published Oct. 14, 2003.
Machine English language translation of JP 2003-291350, published Oct. 14, 2003.

* cited by examiner

*Primary Examiner* — Geoffrey Mruk
(74) *Attorney, Agent, or Firm* — Staas & Halsey LLP

(57) ABSTRACT

Provided are an inkjet printhead and a method of driving the inkjet printhead. The inkjet printhead includes a heater configured to heat ink to produce ink bubbles, an electrode configured to apply or provide the current to the heater, and a resistor connected to the electrode and separated by a distance from the heater. The resistor having a negative temperature coefficient of resistance (NTC) that can be used to compensate for the effects that temperature has on the ejection speed and mass of ejected ink droplets produced by the inkjet printhead and that result from temperature changes that occur during the operation of the inkjet printhead.

15 Claims, 7 Drawing Sheets

THERMAL INKJET PRINTHEAD AND METHOD OF DRIVING SAME

CROSS-REFERENCE TO RELATED PATENT APPLICATION

This application claims the benefit of Korean Patent Application No. 10-2008-0079925, filed on Aug. 14, 2008 in the Korean Intellectual Property Office, the disclosure of which is incorporated herein by reference in its entirety.

TECHNICAL FIELD

The present disclosure generally relates to a thermal inkjet printhead and a method of driving the thermal inkjet printhead.

BACKGROUND OF RELATED ART

Generally, an inkjet printhead of a printer is an apparatus that ejects, sends, or discharges fine droplets of a printing ink on a desired area of a recording medium to reproduce a predetermined image, such as a color image on the recording medium. Inkjet printhead can be generally classified into two types according to the mechanism that is used to eject the ink droplets. A first type of inkjet printhead is a thermal inkjet printhead in which the ink droplets are ejected by an expansion force produced by bubbles generated when the ink is heated up by a thermal source. A second taupe of inkjet printhead is a piezoelectric inkjet printhead in which the ink droplets are ejected when pressure is applied to the ink by a deformation of a piezoelectric element.

The mechanism that is used to eject ink droplets from a thermal inkjet printhead will be described below in more detail. A pulse current is applied to a resistive heating material or heating element in a heater such that ink in an ink chamber that is close to or adjacent to the heater is immediately heated up to about 300 degrees Celsius (° C.). When heated, the ink boils and produces bubbles that expand and pressurize the ink within the ink chamber. As a result, the ink in the ink chamber that is located near a nozzle of the inkjet printhead is ejected or discharged through the nozzle as ink droplets.

To improve the printing quality that can be achieved using inkjet printheads, it is desirable that the ejection speed and the mass of the ink droplets ejected from the inkjet printhead be maintained uniform through a wide range of environmental and/or operational conditions of the printer. The nozzles in an inkjet printhead generally have different print logs according to the printing data that is provided to each of the nozzles. As a result, temperature conditions can be different around each of the nozzles in the inkjet printhead. Moreover, when printing for the first time, changes in the printing environment, such as a change in the temperature outside the printer, for example, can affect the characteristics of the ejected ink droplets. Accordingly, by compensating for temperature changes that occur around each of the nozzles, the mass and/or the ejection speed of the ink droplets ejected from the inkjet printhead nozzles can be maintained substantially uniform across the nozzles.

SUMMARY OF DISCLOSURE

A thermal inkjet printhead and a method of driving the thermal inkjet printhead capable of providing constant or uniform ejection speed and/or mass of ink droplets ejected from nozzles during a printing operation are described.

According to an aspect of the invention, there is provided an inkjet printhead that includes a heater that generates bubbles by heating ink, an electrode that applies a current to the heater; and a resistor that is separated from the heater by a distance and formed to be coupled to the electrode. The resistor has a negative temperature coefficient of resistance (NTC).

The resistor can be used to maintain uniformity in the ejection speed and the mass of the ink droplets that are ejected from the inkjet printhead by having the electrical resistance of the resistor vary in accordance with the temperature changes around the heater. By reducing the resistance of the resistor as a result of the increase in temperature around the heaters, a voltage that is applied to the heater is increased. The resistor can be serially connected to the electrode. Moreover, the resistor can be a thermistor having a negative temperature coefficient of resistance. A driving transistor configured to drive the heater can be coupled to the electrode. The resistor can be disposed between the driving transistor and the heater. The distance between the resistor and the heater can be in the range from about 1 micron to about 200 microns.

According to another aspect of the invention, there is provided an inkjet printhead that includes a substrate, an insulating layer formed above the substrate, a plurality of heaters formed above the insulating layers and configured to heat up ink to produce ink bubble, a plurality of electrodes that apply current to the heaters, a passivation layer formed to cover the heaters and the electrodes, a plurality of resistors formed above the passivation layer and to be coupled to the electrodes and having a negative temperature coefficient of resistance (NTC), a chamber layer stacked above the passivation layer and comprising a plurality of ink chambers, and a nozzle layer stacked above the chamber layer and comprising a plurality of nozzles.

According to another aspect of the invention, there is provided a method of driving an inkjet printhead having a heater that generates an ink bubble by heating ink, an electrode that provides the current to the heater. The method includes supplying a voltage across a resistor and the heater such that a first voltage is applied to the heater thereby causing ejection of ink droplets from a nozzle of the inkjet printhead. The electrical resistance of the resistor varies as the temperature around the heater varies. The method further includes applying a second voltage to the heater as the electrical resistance of the resistor varies such that the ejection speed and mass of the ink droplets are uniformly maintained as the temperature changes around the heater.

The electrical resistance of the resistor can be decreased with the increase of the temperature around the heater. As the electrical resistance of the resistor is decreased, the second voltage applied to the heater is greater than the first voltage applied to the heater. The size of ink bubbles that are generated when the second voltage is applied to the heater can be smaller than the size of ink bubbles generated when the first voltage is applied to the heater.

BRIEF DESCRIPTION OF THE DRAWINGS

Various aspects of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
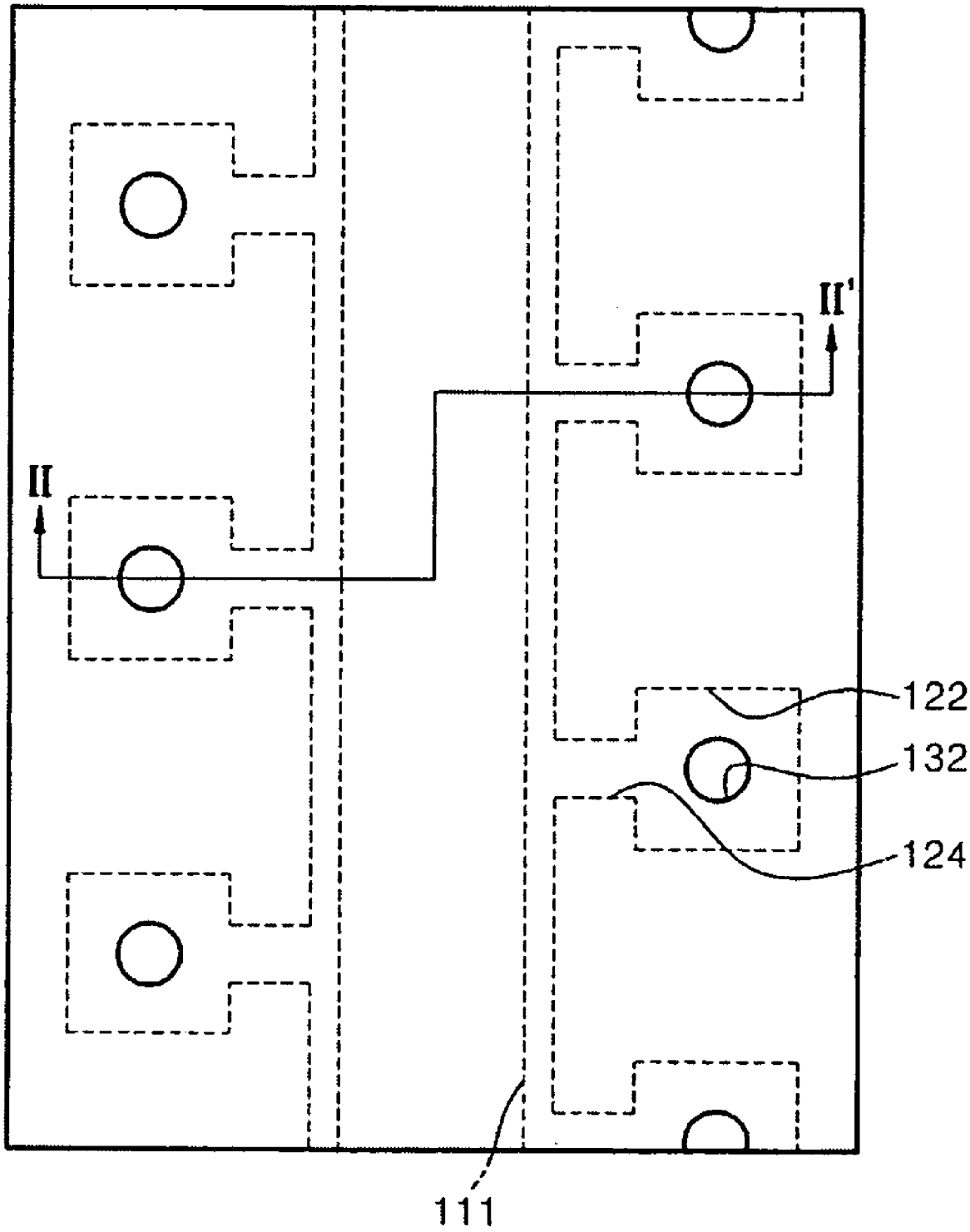
FIG. 1 is a plan view of an inkjet printhead, according to an embodiment.

One or more embodiments of the present invention will now be described more fully with reference to the accompanying drawings. Like reference numerals in the drawings denote like elements, and the sizes and thicknesses of the elements in the drawings may be exaggerated for clarity of description. It will also be understood that when a layer is referred to as being "on" another layer or substrate, the layer can be directly on the other layer or substrate, or there could be intervening layers between the layer and the other layer or substrate.

Figure 2:
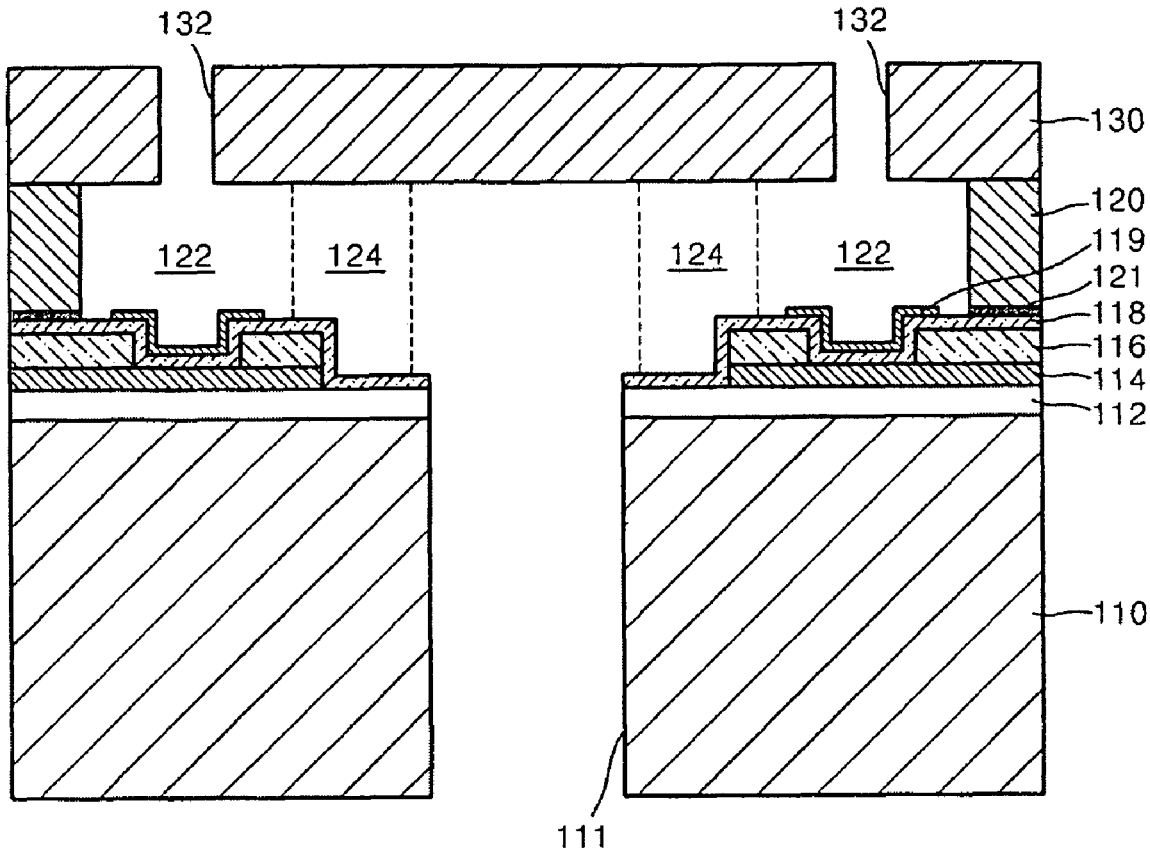
FIG. 2 is a cross-sectional view of the inkjet printhead of FIG. 1, taken along a line II-II'.
Figure 3:
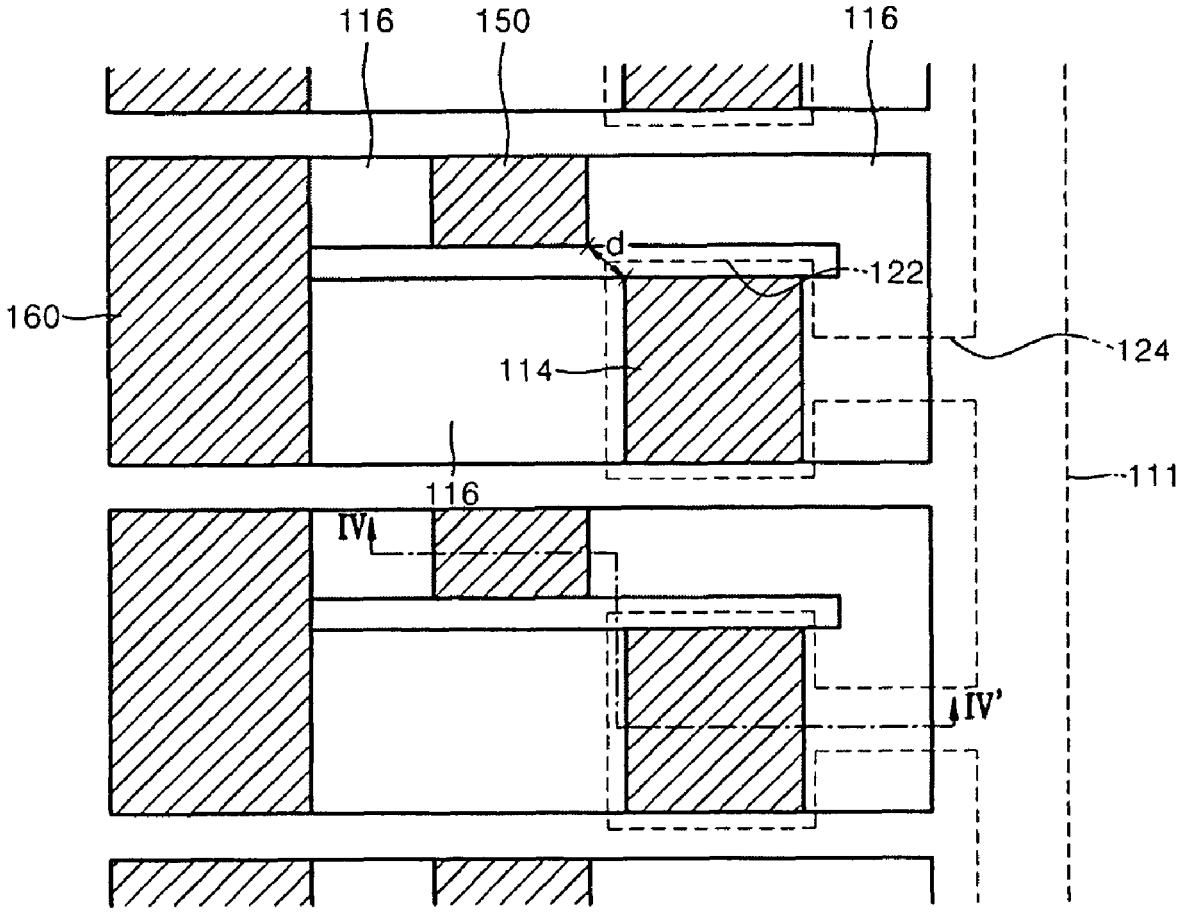
FIG. 3 is a plan view of a portion around heaters illustrated in FIG. 2.
Figure 4:
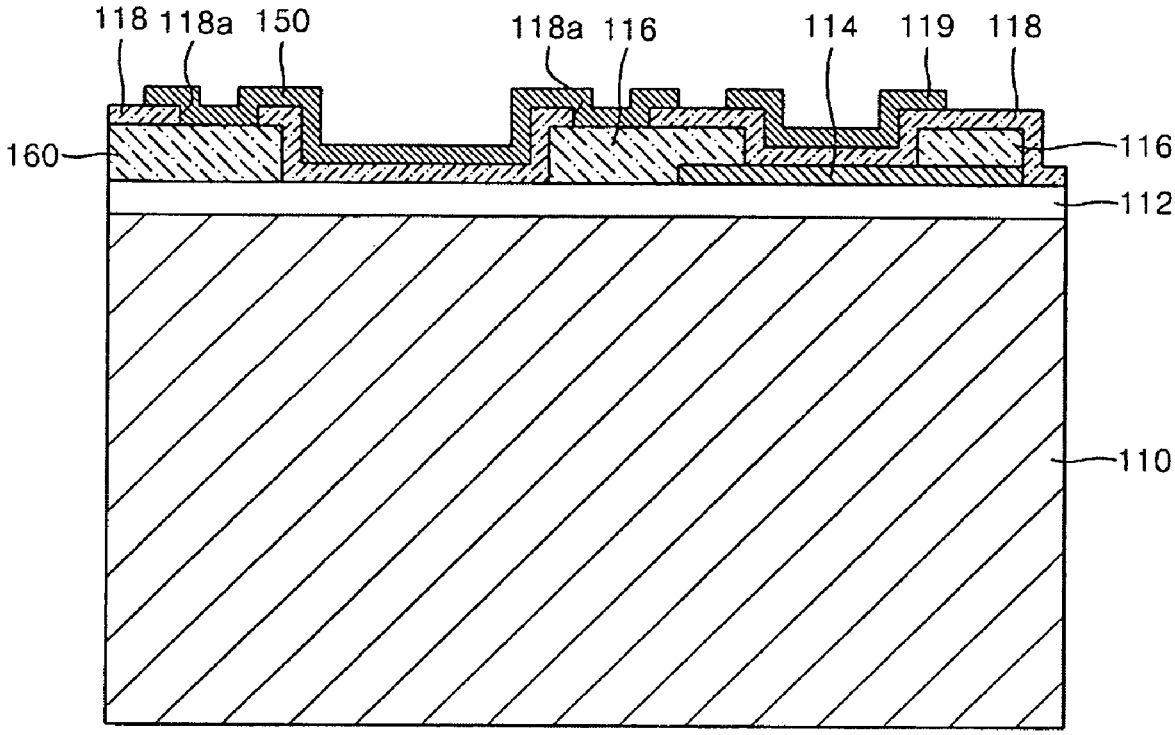
FIG. 4 is a cross-sectional view of the portion illustrated in FIG. 3, taken along a line IV-IV'.

FIG. 1 is a plan view of an inkjet printhead, according to an embodiment. FIG. 2 is a cross-sectional view of the inkjet printhead of FIG. 1, taken along line II-II'. FIG. 3 is a plan view of a portion around heaters 114 illustrated in FIG. 2. FIG. 4 is a cross-sectional view of the portion illustrated in FIG. 3, taken along a line IV-IV'.

Referring to FIGS. 1 and 2, the inkjet printhead may include a substrate 110 on which a plurality of material layers are formed or disposed, a chamber layer 120 disposed (e.g., stacked) on the substrate 110, and a nozzle layer 130 disposed (e.g., stacked) on the chamber layer 120. The substrate 110 can be made of a semiconductor material such as silicon, for example. An ink feedhole 111, for supplying ink within the inkjet printhead, may be formed through the substrate 110. The chamber layer 120 includes one or more ink chambers 122 that can be filled with ink supplied through the ink feedhole 111. The chamber layer 120 may also include one or more restrictors 124. Each restrictor 124 is a passage or conduit that connects the ink feed hole 111 to one of the ink chambers 122 in the chamber layer 120. The nozzle layer 130 may include one or more nozzles 132 through which ink from the ink chambers 122 is ejected. Each nozzle 132 in the nozzle layer 130 can be located substantially above an associated ink chamber 122 in the chamber layer 120.

An insulating layer 112 can be placed on a top surface of the substrate 110. The insulating layer 112 can be made of silicon oxide, for example. One or more heaters 114 are formed on the insulating layer 112 and are configured to heat up the ink in the ink chambers 122 to produce ink bubbles. The heaters 114 (e.g., resistors, resistive elements) can be made of a heat-generating material such as tantalum-aluminum alloy, tantalum nitride, titanium nitride, and tungsten silicide, for example. The heaters 114, however, need riot be so limited and can also be made of any other heat-generating materials. An electrode 116 is formed on each of the heaters 114 to apply current to the heater 114. The electrode 116 may be made of a material having good electrical conductivity such as aluminum (Al), aluminum alloy, gold (Au), and silver (Ag), for example. The electrodes 116, however, need not be so limited and can also be made of any other materials with good electrical conductivity. The current provided to each of the heaters 114 is driven by an associated driving transistor 160 (described below with respect to FIG. 4). The driving transistors 160 are connected to the heaters 114 via the electrodes 116.

A passivation layer 118 can be formed on the insulating layer 112 in such a manner that the passivation layer 118 covers the heaters 114 and the electrodes 116. The passivation layer 118 is provided to prevent oxidization or corrosion of the heaters 114 and the electrodes 116 that would otherwise occur as the heaters 114 and the electrodes 116 contact the ink. The passivation layer 118 may be a layer of silicon nitride or silicon oxide, for example, being formed on the surface of the heaters 114 and/or the electrodes 116. An anti-cavitation layer 119 can be formed or disposed on a top surface of the passivation layer 118 and substantially above each of the heaters 114 to protect the heaters 114 from a cavitation force that is generated when the ink bubbles burst. The anti-cavitation layer 119 can be made of tantalum (Ta), for example. Moreover, a glue layer 121 can be formed or disposed on the passivation layer 118 such that the chamber layer 120 can easily adhere to the passivation layer 118.

FIGS. 3 and 4 illustrate resistors 150, which are configured to have a negative temperature coefficient of resistance (NTC). Each of the resistors 150 corresponds to an associated heater 114. The resistor 150 is serially connected to the electrode 116 that connects the driving transistor 160 to the heater 114. The resistors 150 may be formed or disposed on the passivation layer 118 and are electrically connected to the electrodes 116 through via-holes 118*a* in the passivation layer 118. The resistor 150 may be offset from an associated heater 114 and may be separated from that heater 114 by a predetermined distance d. For example, a typical distance d between the resistor 150 and the heater 114 can be in the range of about 1 micron to about 200 microns. The resistors 150, however, need not be so limited. For example, the resistor 150 can be located to correspond to or overlap with the associated heater 114 while maintaining the ejection speed and the mass of ink droplets uniform across each of the inkjet printhead nozzles as the resistance in the resistors 150 varies in response to the temperature changes around the heater 114.

The resistor 150 can be a thermistor having a negative temperature coefficient of resistance (NTC thermistor). A thermistor is a device that is typically used to measure temperatures of approximately 300° C. or less with relative accuracy. A thermistor can be made of a metal alloy of cobalt (Co), molybdenum (Mo), nickel (Ni), copper (Cu), and iron (Fe). A thermistor can have a resistance value that ranges from several ohms (Ω) to several kilo-ohms at room temperature, and a temperature coefficient of resistance (TCR) that ranges from about −0.05 to about 0.01. In the present embodiment, the resistor 150 is an NTC thermistor, that is, the resistance of the thermistor decreases with an increase in temperature.

Figure 5:
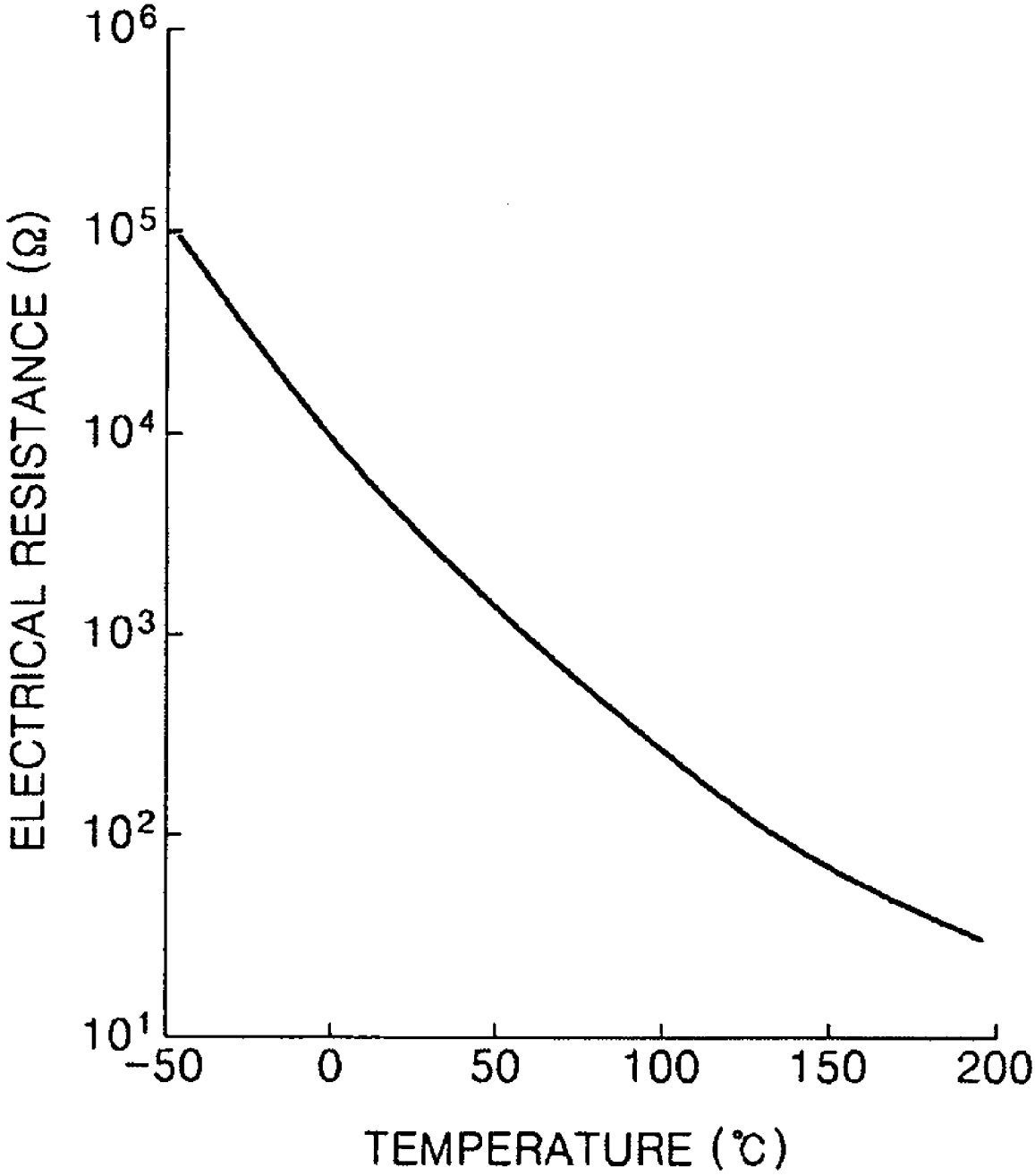
FIG. 5 is a graph showing the electrical resistance of a typical negative temperature coefficients (NTC) thermistor according to changes in temperature.

FIG. 5 is a graph showing the electrical resistance behavior of a typical NTC thermistor in response to changes in temperature. Referring to FIG. 5, the behavior of the NTC thermistor is such that the electrical resistance decreases as the temperature increases.

In a typical thermal inkjet printhead, the behavior of each of the heaters 114 is based on a predetermined input data used to drive the heaters 114. Based on this input data, the heaters 114 heat up the ink in the ink chambers 122 and produce bubbles that expand within the ink chambers 22 such that ink droplets having a predetermined ejection speed and mass are ejected from the nozzles 132. As a result of this process, the temperature around the heaters 114 is increased locally and such temperature increase changes the properties of the ink around or nearby the heaters 114. For example, the viscosity and/or the surface tension of the ink decrease as a result of the increase in temperature around the heaters 114. The ejection speed and the mass of the ejected ink droplets increase when the viscosity and surface tension of the ink decrease as the temperature around the heaters 114 increases. As a result, the printing quality during a continuous printing process is degraded because of the increase in the ejection speed and the mass of the ink droplets ejected from the nozzles 132 that occurs when the temperature around the heaters 114 increases.

However, the inkjet printhead, according to an embodiment of the present invention, can maintain uniformity in the ejection speed and the mass of the ejected droplets over time and across the multiple nozzles 132 by using the above-described NTC thermistors as resistors 150 and varying the size of bubbles in accordance with the temperature change around the heaters 114.

For example, when the operational temperature range of the inkjet printhead is approximately 35 to 50° C. and the resistor 150 is an NTC thermistor having an electrical resistance of about 25Ω at room temperature of about 25° C. and a temperature coefficient of resistance (TCR) of −0.04, then the electrical resistance of the resistor 150 in the operational temperature range changes by a maximum of about 15Ω. Thus, when the temperature around a heater 114 is increased from 35° C. to 50° C., the electrical resistance of the resistor 150 is reduced by about 15Ω. Because the heater 114 is made of a material having a very small TCR, changes in the electrical resistance of the heater 114 are typically unnoticeable. Thus, because a voltage applied to a driving transistor 160 to operate the heater 114 is substantially constant (e.g., uniform), when a voltage applied to the resistor 150 decreases as a result of the increase in temperature, the voltage that is applied to the heater 114 increases by an amount that corresponds to the decrease in the voltage applied to the resistor 150. As a result of the increase in the voltage applied to the heater 114, the power $Power_{heater}$ applied to the heater 114 is increased as described in Equation 1 below.

$$Power_{heater}=(V_o^2\times R_{heater})/(R_{heater}+R_{NTC\ resistor}+R_{electrode})^2, \quad \text{Equation 1:}$$

where $Power_{heater}$ is the power applied to the heater 114, $V_o$ is a uniform driving voltage applied to the driving transistor 160, and $R_{heater}$, $R_{NTC\ resistor}$, and $R_{electrode}$ are the resistances of the heater 114, the NTC resistor 150, and the electrode 116, respectively. When the power or voltage applied to the heater 114 is increased, the size of the ink bubbles produced by the heater 114 is decreased.

Figure 6:
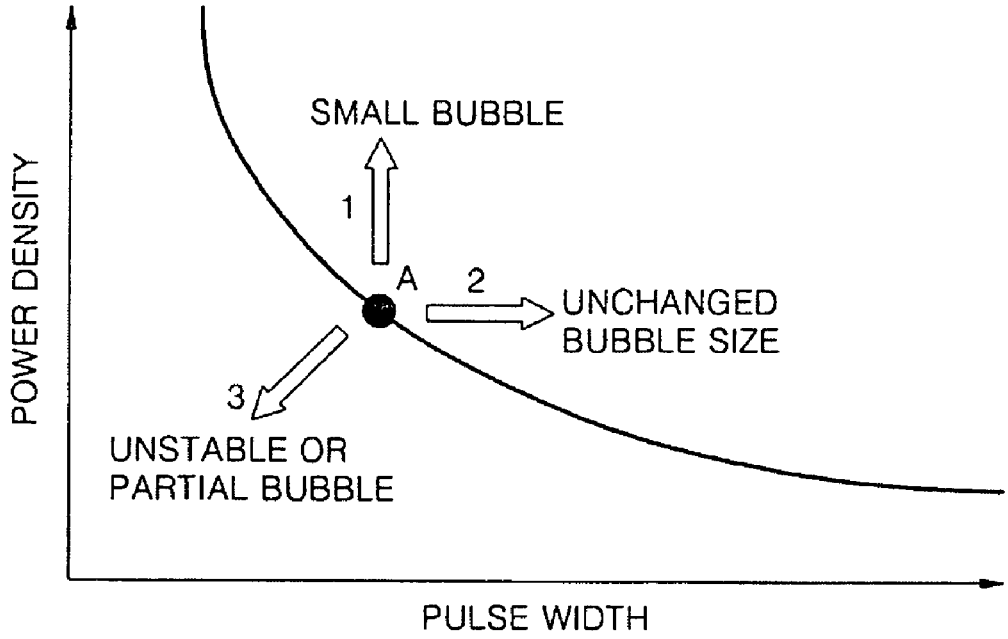
FIG. 6 is a graph showing variation in the size of bubbles according to the power density applied to a heater.

FIG. 6 is a graph showing variation in the size of the ink bubbles according to the power density applied to the heater 114. Referring to FIG. 6, when the voltage applied to the heater 114 has a uniform or constant pulse width, the size of the bubbles produced by the heater 114 is decreased as the power density applied to the heater 114 is increased. This reduction in the size of the ink bubbles occurs because the heat flux from the heater 114 also increases when the power applied to the heater 114 is increased. By increasing the heat flux, the time required for heat to be transferred to a fluid (e.g., ink) around the heater 114 is reduced and the volume of ink that is need to produce the ink bubbles is also reduced because of the shorter heat transfer time. Accordingly, as the power or voltage applied to the heater 114 is increased, the size of the ink bubbles generated by the heater 114 is reduced. By decreasing the size of the ink bubbles, the ejection speed and the mass of the ink droplets ejected from the nozzle 132 can be maintained substantially the same as they were before the temperature around the heater 114 increased. In this embodiment, the resistor 150 is configured to have an appropriate TCR corresponding to the operational temperature range of the inkjet printhead and an appropriate electrical resistance at room temperature. FIG. 6 also shows that the size of the ink bubbles does not change substantially when the pulse width of the voltage applied to the heater 114 is increased.

Figure 7A:
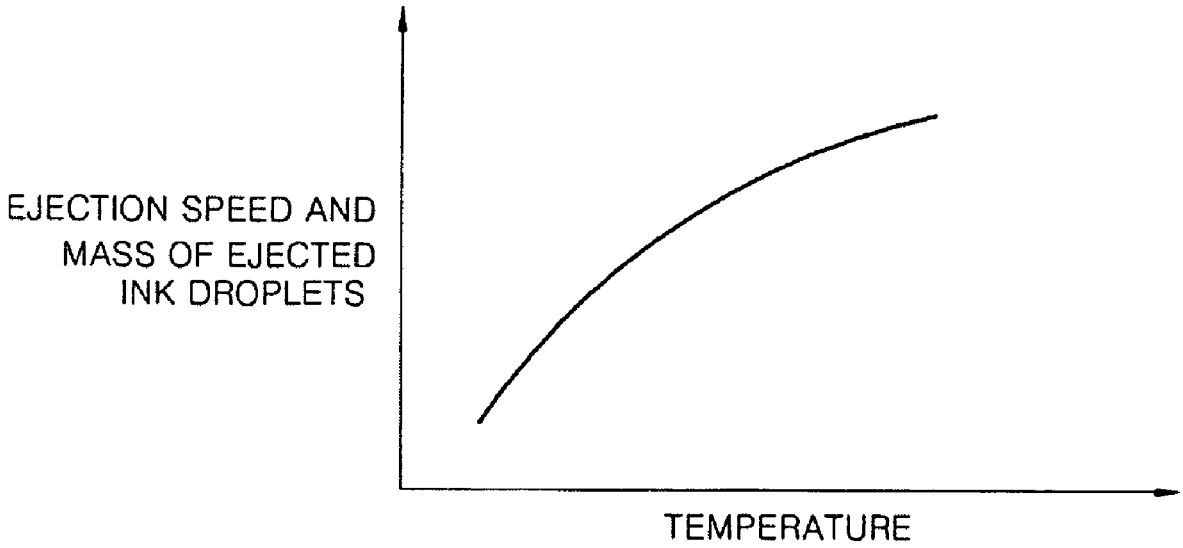
FIG. 7A is a graph showing that the ejection speed and the mass of ink droplets increase as the temperature around the heater is increased in a conventional inkjet printhead that does not include a resistor having an NTC.
Figure 7B:
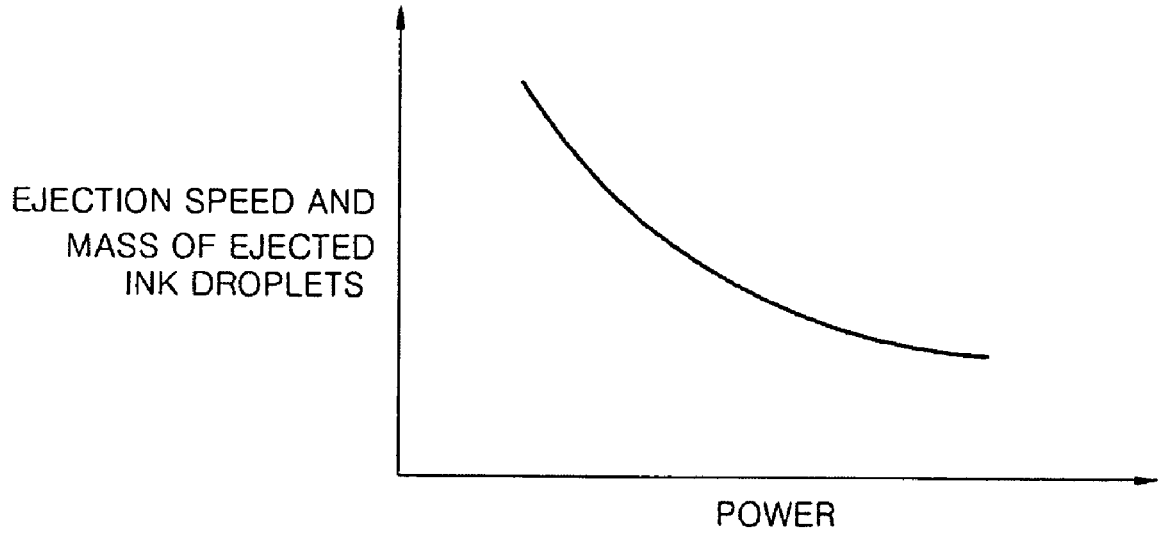
FIG. 7B is a graph showing that at a uniform temperature around the heater, the ejection speed and the mass of ink droplets decrease as the power applied to the heater increases.

FIG. 7A is a graph that illustrates the variation in the ejection speed and the mass of the ink droplets when the temperature around a heater is increased in a conventional inkjet printhead that does not include a resistor 150 having an NTC. Referring to FIG. 7A, the ejection speed and the mass of the ejected ink droplets increases as the temperature around the heater increases. FIG. 7B is a graph showing that at a uniform temperature around the heater 114, the ejection speed and the mass of ink droplets decrease as the power applied to the heater 114 is increased.

Figure 7C:
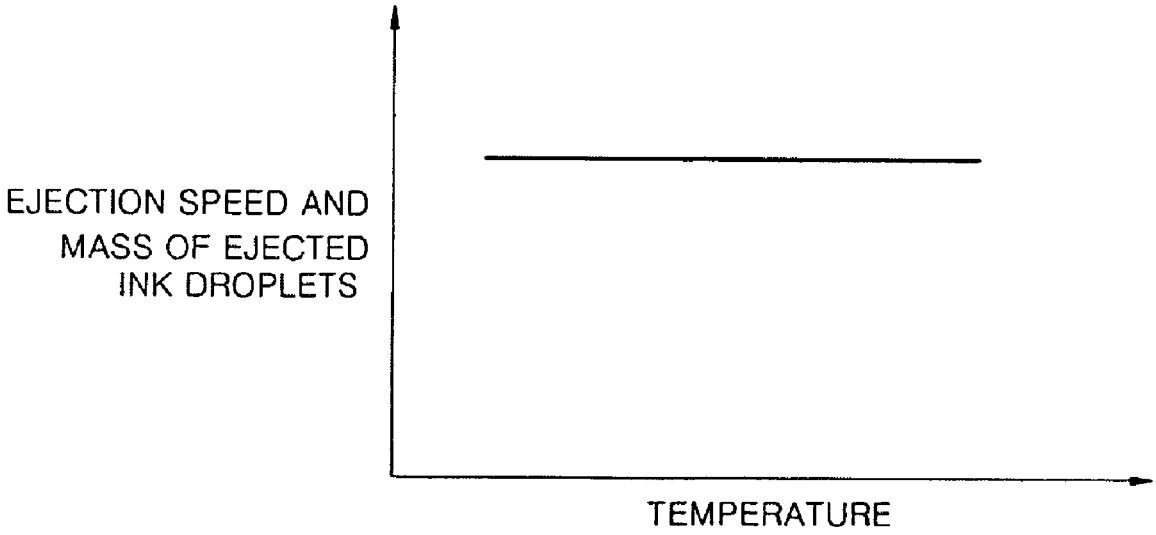
FIG. 7C is a graph showing that the ejection speed and the mass of ink droplets are maintained uniform even when the temperature around the heater is increased in an inkjet printhead including a resistor having an NTC, according to an embodiment.

FIG. 7C is a graph that illustrates the variation in the ejection speed and the mass of ink droplets when the temperature around a heater is increased in an inkjet printhead that includes a resistor 150 having an NTC, according to an embodiment. Referring to FIG. 7C, the ejection speed and the mass of the ejected ink droplets are maintained substantially uniform or the same while the temperature around the heater 114 increases.

As described above, when the temperature around the heater 114 in the inkjet printhead is increased by driving the heater 114, the electrical resistance of the resistor 150 having an NTC is reduced such that a voltage applied to the heater 114 is increased and the size of the ink bubbles produced in the heater 114 decreases. This reduction in the size of the ink bubbles prevents or limits the ejection speed and the mass of the ejected ink droplets from increasing when the temperature around the heater 114 increases. As a result, the ejection speed and the mass of the ejected ink droplets can be maintained substantially uniform or constant in real-time during the printing operation. In the current embodiment, because a resistor 150 is used with each of the heaters 114, the ejection speed and the mass of the ejected ink droplets can be maintained substantially uniform or constant across all of the heaters 114 when the temperature around any one of the heaters 114 varies according to the print log associated with that heater 114.

The operation of the above-described inkjet printhead according to an embodiment of the invention will be described below.

A heater driving voltage for driving each of the heaters 114 is applied to each of the driving transistors 160. As a result, the driving transistors 160 apply a predetermined first voltage to the heaters 114 and ink bubbles of a predetermined size are produced by the heat that results from the driving heaters 114 with the predetermined first voltage. Ink droplets having predetermined ejection speed and mass are ejected through the corresponding nozzle 132 by the expansion of the ink bubbles.

The temperature around the heaters 114 is locally increased as a result of the predetermined first voltage being used to drive the heaters 114. The properties of the ink in the ink chambers 122 associated with the heaters 144 change because of the temperature increase around the heaters 114. For example, the temperature increase around the heaters 114 results in a decrease in the viscosity and in the surface tension of the ink around the heaters 114. The electrical resistance associated with the resistor 150 (e.g., NTC thermistor) is reduced when the temperature around the heaters 114 increases. Moreover, any change in the electrical resistance of the heaters 114 that results from a change in temperature is typically negligible because the temperature coefficient of resistance (TCR) of the heaters 114 is very small.

When the electrical resistance of the resistor 150 decreases because of an increase in temperature, a predetermined second voltage greater than the predetermined first voltage described above is applied to the heaters 114. The ink bubbles produced when the second voltage is applied are smaller than those produced when the first voltage is applied. By adjusting the size of the ink bubbles through a change in the voltage applied to the heaters 114, the ejection speed and the mass of the ejected ink droplets can be maintained substantially uniform or constant as the temperatures around the heaters 114 increases. That is, the ejection speed and the mass of the ink droplets ejected by the ink bubbles produced when the first voltage is applied to the heaters 11 are substantially the same as the ejection speed and the mass of the ink droplets ejected by the ink bubbles produced when the second voltage is applied to the heaters 114. The ink bubbles produced when the first voltage is applied to the heaters 114 are larger than the ink bubbles produced when the second voltage is applied to the heaters 114. Thus, the increase in the ejection speed and the mass of the ejected ink droplets that results from the increase in temperature around the heaters 114 is offset by the decrease in the size of the ink bubbles caused by applying a higher voltage to the heaters 114.

The above-described process compensates for the temperature change of the inkjet printhead during the printing process. Thus, the printing quality is increased by maintaining the ejection speed and the mass of ejected ink droplets substantially uniform or constant over time and across the nozzles 132.

According to the above embodiments, the effects that a temperature change around the nozzles 132 produces can be compensated for in real-time by connecting a resistor 150 having a negative temperature coefficient of resistance (NTC) to each of the electrodes 116 that apply a current to the heaters 114. Such an approach results in the speed and the mass of the ink droplets ejected from the nozzles 132 during the printing operation to be substantionally uniform or constant.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An inkjet printhead, comprising:

a heater configured to generate heat according to received current, and to thereby heat ink to cause ink bubbles;

an electrode electrically coupled to the heater to provide the current to the heater; and a resistor electrically coupled to the electrode, the resistor having a negative temperature coefficient of resistance (NTC) for increasing a voltage applied to the heater when a temperature around the heater is increased, the resistor being spaced apart from the heater by a distance.

2. The inkjet printhead of claim 1, wherein the resistor is configured to vary its electrical resistance based on temperature changes around the heater to cause ejection speed and mass of ink droplets ejected through a nozzle associated with the heater to remain substantially the same over a range of temperature changes.

3. The inkjet printhead of claim 2, wherein, when the temperature around the heater increases, the resistor is configured to reduce its electrical resistance to cause a voltage applied to the heater to increase.

4. The inkjet printhead of claim 1, wherein the resistor is serially connected to the electrode.

5. The inkjet printhead of claim 1, wherein the resistor is a thermistor.

6. The inkjet printhead of claim 1, further comprising:

a driving transistor electrically coupled to the electrode, the driving transistor being configured to drive the heater.

7. The inkjet printhead of claim 6, wherein the resistor is disposed between the driving transistor and the heater.

8. An inkjet printhead, comprising:

a heater configured to generate heat according to received current, and to thereby heat ink to cause ink bubbles;

an electrode electrically coupled to the heater to provide the current to the heater; and a resistor electrically coupled to the electrode, the resistor having a negative temperature coefficient of resistance (NTC), the resistor being spaced apart from the heater by a distance, wherein the distance between the resistor and the heater is in the range of about 1 micron to about 200 microns.

9. An inkjet printhead, comprising:

a substrate;

an insulating layer disposed above the substrate;

a plurality of heaters disposed above the insulating layer, each of the plurality of heaters being configured to heat ink to produce an ink bubble;

a plurality of electrodes each electrically coupled to respective associated on of the plurality of heaters to provide thereto a current;

a passivation layer disposed above the heaters and the electrodes;

a plurality of resistors disposed above the passivation layer, the plurality of resistors each having a negative temperature coefficient of resistance (NTC) for increasing a voltage applied to the heater when a temperature around the heater is increased and being electrically coupled to a respective associated one of the plurality of electrodes;

a chamber layer disposed above the passivation layer and having a plurality of ink chambers, each of the plurality of ink chambers being associated with a respective corresponding one of the plurality of heaters; and a nozzle layer disposed above the chamber layer and having a plurality of nozzles, each of the plurality of nozzles being associated with a respective corresponding one of the plurality of ink chambers.

10. The inkjet printhead of claim 9, wherein each of the plurality of resistors is configured to vary its electrical resistance based on temperature changes around the heater associated with that resistor to cause ejection speed and mass of ink droplets ejected through the nozzle associated with that heater to remain substantially the same over a range of temperature changes.

11. The inkjet printhead of claim 9, wherein each of the plurality of resistors is serially connected to the respective associated one of the plurality of electrodes.

12. The inkjet printhead of claim 9, further comprising a plurality of driving transistors, each of which being associated with a respective corresponding one of the plurality of heaters to drive the associated heater and being connected to one of the plurality of electrodes associated with the associated heater.

13. The inkjet printhead of claim 12, wherein each of the plurality of resistors is disposed between the associated one of the plurality of driving transistors and the associated one of the plurality of electrodes.

14. An inkjet printhead, comprising:

a substrate;

an insulating layer disposed above the substrate;

a plurality of heaters disposed above the insulating layer, each of the plurality of heaters being configured to heat ink to produce an ink bubble;

a plurality of electrodes each electrically coupled to respective associated on of the plurality of heaters to provide thereto a current;

a passivation layer disposed above the heaters and the electrodes;

a plurality of resistors disposed above the passivation layer, the plurality of resistors each having a negative temperature coefficient of resistance (NTC) and being electrically coupled to a respective associated one of the plurality of electrodes;

a chamber layer disposed above the passivation layer and having a plurality of ink chambers, each of the plurality of ink chambers being associated with a respective corresponding one of the plurality of heaters; and a nozzle layer disposed above the chamber layer and having a plurality of nozzles, each of the plurality of nozzles being associated with a respective corresponding one of the plurality of ink chambers, wherein each of the plurality of resistors is serially connected to the respective associated one of the plurality of electrodes through a via-hole in the passivation layer.

15. An inkjet printhead, comprising:

a substrate;

an insulating layer disposed above the substrate;

a plurality of heaters disposed above the insulating layer, each of the plurality of heaters being configured to heat ink to produce an ink bubble;

a plurality of electrodes each electrically coupled to respective associated on of the plurality of heaters to provide thereto a current;

a passivation layer disposed above the heaters and the electrodes;

a plurality of resistors disposed above the passivation layer, the plurality of resistors each having a negative temperature coefficient of resistance (NTC) and being electrically coupled to a respective associated one of the plurality of electrodes;

a chamber layer disposed above the passivation layer and having a plurality of ink chambers, each of the plurality of ink chambers being associated with a respective corresponding one of the plurality of heaters; and a nozzle layer disposed above the chamber layer and having a plurality of nozzles, each of the plurality of nozzles being associated with a respective corresponding one of the plurality of ink chambers, wherein each of the plurality of resistors being spaced apart from a respective associated one of the plurality heaters by a distance, the distance being in the range of about 1 micron to about 200 microns.

* * * * *

UNITED STATES PATENT AND TRADEMARK OFFICE

CERTIFICATE OF CORRECTION

PATENT NO. : 8,182,071 B2
APPLICATION NO. : 12/389113
DATED : May 22, 2012
INVENTOR(S) : Keon Kuk It is certified that error appears in the above-identified patent and that said Letters Patent is hereby corrected as shown below:

Column 8, Line 38, In Claim 9, delete "on of the" and insert -- one of the --, therefor.
Column 9, Line 17, In Claim 14, delete "on of the" and insert -- one of the --, therefor.
Column 10, Line 11, In Claim 15, delete "on of the" and insert -- one of the --, therefor.

Signed and Sealed this
Twenty-fourth Day of July, 2012

David J. Kappos

David J. Kappos
*Director of the United States Patent and Trademark Office*